US005834927A

United States Patent [19]

Sugawara

[11] Patent Number: 5,834,927

[45] Date of Patent: Nov. 10, 1998

[54] REFERENCE VOLTAGE GENERATING CIRCUIT GENERATING A REFERENCE VOLTAGE SMALLER THAN A BANDGAP VOLTAGE

[75] Inventor: Michinori Sugawara, Tokyo, Japan

[73] Assignee: NEC Corporation, Tokyo, Japan

[21] Appl. No.: 825,386

[22] Filed: Mar. 28, 1997

[30] Foreign Application Priority Data

Mar. 28, 1996 [JP] Japan ..... 8-74695

[51] Int. Cl.[6] ..... G05F 3/16

[52] U.S. Cl. ..... 323/314; 323/907; 323/316; 327/539

[58] Field of Search ..... 323/313, 314, 323/316, 907; 327/539, 541

[56] References Cited

U.S. PATENT DOCUMENTS

| | | | |
|---|---|---|---|
| 4,349,778 | 9/1982 | Davis | 323/314 |
| 4,352,056 | 9/1982 | Cave et al. | 323/314 |
| 4,422,033 | 12/1983 | Minner et al. | 323/314 |
| 4,658,205 | 4/1987 | Yamada | 323/313 |
| 5,278,491 | 1/1994 | Nitta et al. | 323/313 |
| 5,552,740 | 9/1996 | Casper | 327/541 |

FOREIGN PATENT DOCUMENTS

| | | |
|---|---|---|
| 61-45315 | 3/1961 | Japan . |
| 3-65716 | 3/1991 | Japan . |
| 3-141411 | 6/1991 | Japan . |

OTHER PUBLICATIONS

L. J. Herbst, "Monolithic Integrated Circuits Techniques and Capabilities", Clarendon Press, Oxford, 1985, pp. 246–247.

*Primary Examiner*—Shawn Riley
*Attorney, Agent, or Firm*—Whitham Curtis & Whitham

[57] ABSTRACT

In a reference voltage generating circuit, a standardized constant voltage measured on the basis of a low power supply voltage as a reference is generated by a constant voltage source connected between a high power supply voltage and the low power supply voltage. The standardized constant voltage is divided by a series circuit composed of first and second resistors sandwiching first and second transistors therebetween, for generating a divided voltage, which is then supplied to a current source composed of a third transistor. A current flowing through the current source is converted into an output voltage measured on the basis of the high power supply voltage as a reference, by third and fourth resistors series-connected to sandwich the third transistor therebetween. The output voltage is converted, by an emitter follower composed of a fourth transistor having a base receiving the output voltage, into a reference voltage measured on the basis of the high power supply voltage as a reference.

7 Claims, 3 Drawing Sheets

REFERENCE VOLTAGE GENERATING CIRCUIT GENERATING A REFERENCE VOLTAGE SMALLER THAN A BANDGAP VOLTAGE

BACKGROUND OF THE INVENTION

1. Field of the invention

The present invention relates to a reference voltage generating circuit incorporated in a semiconductor integrated circuit, and more specifically to a reference voltage generating circuit configured to receive an output voltage of a bandgap type constant voltage source, for generating a reference voltage which has an absolute value smaller than a bandgap voltage and which has almost no temperature dependency. For example, the bandgap voltage is about 1.25 V, and the absolute value is 1 V.

2. Description of Related Art

Referring to FIG. 1, there is shown a circuit diagram of one example of a prior art reference voltage generating circuit of this type. The shown reference voltage generating circuit includes a bandgap type constant voltage source 10 composed of bipolar transistors $Q_{21}$ to $Q_{24}$ and resistors $R_{21}$ to $R_{24}$ connected as shown, for generating a standardized constant voltage $V_{BO}$ measured on the basis of a low power supply voltage $V_{EE}$ as a reference. This bandgap type constant voltage source 10 is disclosed by for example U.S. Pat. No. 5,278,491 which corresponds to Japanese Patent Application Laid-open Publication No. JP-A-3-065716, and the disclosure of which is incorporated by reference in its entirety the present application.

The shown reference voltage generating circuit also includes a current source and emitter follower circuit composed of bipolar transistors $Q_3$ to $Q_4$ and resistors $R_4$ to $R_6$ connected as shown, and receiving the standardized constant voltage $V_{BO}$, for the purpose of generating a reference voltage $V_{RO}$ measured on the basis of a high power supply voltage $V_{CC}$. The current source and emitter follower circuit is disclosed by for example U.S. Pat. No. 4,658,205 which corresponds to Japanese Patent Application Laid-open Publication No. JP-A-61-045315, and the disclosure of which is incorporated by reference in its entirety into the present application. In particular, $R_4=R_5$.

Now, operation of the circuit shown in FIG. 1 will be described. If an emitter area ratio of the bipolar transistors $Q_{22}$ and $Q_{23}$ and a resistance ratio of the resistors $R_{21}$ and $R_{22}$ are suitably selected, the bandgap type constant voltage source 10 has almost no temperature dependency (this will be called simply a "zero temperature dependency"), and generates the standardized constant voltage $V_{BO}$ which is substantially equal to a bandgap voltage $V_{GO}$ of silicon (about 1205 mV) at a temperature of 0 K. Here, the voltage $V_{BO}$ is deemed as being about 1250 mV, and will be called a "bandgap voltage" and identified with Vgn. For example, it can be realized by setting to the effect that $R_{21}=R_{23}=1$ KΩ, $R_{22}=0.12$ KΩ, $R_{24}=2.5$ KΩ and the emitter area ratio is $Q_{21}:Q_{22}:Q_{23}:Q_{24}=2:10:1:2$. In this case, the reference voltage $V_{RO}$ can be given by the following equation:

$$V_{RO}-(R_5/R_4)\cdot V_{BO}+(R_5/R_4)\cdot V_{BE2}-V_{BE1}$$

where $V_{BE1}$ and $V_{BE2}$ are a forward direction voltage of the bipolar transistors $Q_{21}$ and $Q_{22}$.

Therefore, assuming $V_{BE1}=V_{BE2}$ and $R_4=R_5$, it becomes $V_{RO}=-V_{BO}$. Namely, the reference voltage having almost no temperature dependency can be obtained. Thus, the circuit shown in FIG. 1 can generate the reference voltage $V_{RO}$ of the zero temperature dependency. However, it would be understood that the absolute value of the reference voltage $V_{RO}$ is equal to the bandgap voltage Vgn.

Referring to FIG. 2, there is shown a circuit diagram of another prior art reference voltage generating circuit, which is proposed by U.S. Pat. No. 4,658,205 (JP-A-61-045315) as being a circuit which can freely set the value of the reference voltage and the temperature dependency. This second prior art reference voltage generating circuit includes a circuit composed of bipolar transistors $Q_3$ and $Q_4$,resistors $R_4$ to $R_6$ and $T_{25}$ and $R_{26}$ and a diode $D_1$ connected as shown, a base of the bipolar transistor $Q_4$ being connected to receive a standardized constant voltage $V_{CS}$ which is generated by a constant voltage source 10A and which is measured on the basis of the low power supply voltage $V_{EE}$ as a reference.

Operation of the second prior art reference voltage generating circuit can be explained as follows:

The value of the reference voltage $V_R$ generated by this circuit and the reference voltage $V_R$ differentiated by temperature are expressed by the following equations (1) and (2):

$$V_R=-(R_5/\Sigma R)\cdot(R_{26}/R_4)\cdot V_{CS}+\{(R_5/\Sigma R)\cdot[(R_{26}/R_4)-1]-1\}V_{BE} \quad (1)$$

$$dV_R/dT=-(R_5/\Sigma R)\cdot(R_{26}/R_4)\cdot dV_{CS}/dT+\{(R_5/\Sigma R)\cdot[(R_{26}/R_4)-1]-1\}dV_{BE}/dT \quad (2)$$

where it is assumed that all a forward direction voltage of the bipolar transistors $Q_3$ and $Q_4$ and a forward direction voltage of the diode $D_1$ are equal to $V_{BE}$, and $\Sigma R=R_4+R_5+R_{25}$.

Since the value of the reference voltage and the derivative of the reference voltage with respect to temperature are given as shown by the equations (1) and (2), it is possible to obtain an arbitrary reference voltage value and the temperature dependency by suitably selecting the resistance ratio and by adjusting the value of $R_5/\Sigma R$ and the value of $R_{26}/R_4$.

However, the second prior art reference voltage generating circuit has a limit in the reference voltage value actually realized and in the range of temperature dependency, because the resistance values can actually take a positive value, and because the constant voltage circuit ordinarily used in a semiconductor integrated circuit cannot actually generate the standardized constant voltage having an arbitrary value and an arbitrary temperature dependency. This limit means that it is impossible to generate a reference voltage having an absolute value smaller than the bandgap voltage and the zero temperature dependency. The reason for this will be described in detail in the following:

First, the temperature dependency of the forward direction voltage $V_{BE}$ in the bipolar transistor will be described, and then, it will be described that an output voltage of the bandgap type constant voltage source based on the forward direction voltage becomes equal to the bandgap voltage Vgn when the temperature dependency is zero. Thereafter, it will be explained that, in the case of using the output voltage of the bandgap type constant voltage source as $V_{CS}$, it is impossible to make the temperature dependency of $V_R$ zero and to make the absolute value of $V_R$ smaller than $V_{CS}$, namely smaller than the bandgap voltage Vgn. Furthermore, the characteristics of an ordinary constant voltage circuit used in the semiconductor integrated circuit will be discused, and it will be also described that, even in this ordinary case, it is impossible to make the temperature dependency of $V_R$ zero and to make the absolute value of $V_R$ smaller than the bandgap voltage Vgn.

The forward direction voltage $V_{BE}$ in the bipolar transistor will be expressed by the following equation (3):

$$V_{BE}=V_{GO}-V_T\{(\gamma-\alpha)InT-InEG\} \quad (3)$$

where $V_T$ is a thermal voltage and expressed by $V_T=kT/q$ (where k is Boltzmann constant, T is an absolute temperature, q is an elementary charge) so that $V_T$ becomes about 26 mV at an ordinary temperature (T=300K);

Ic is a collector current;

$\gamma$, $\alpha$, E, and G are constants independent of temperature;

$V_{GO}$ is the bandgap voltage of silicon at 0K (about 1205 mV).

The equation (3) is quoted from P. R. Gray and R. G. Meyer, translated by Fijuro Nakahara et al, "Analog Integrated Circuit: Design and Technology", Vol.1, Page 271. The following equation can be obtained by differentiating the equation (3) by the temperature T:

$$dV_{BE}/dT=(V_{BE}-Vg)/T \quad (4)$$

where $Vg=V_{GO}+2V_T$ it is assumed that $\gamma=3.2$ and $\alpha=1.2$ for simplification (in this connection, the above quoted literature assumes that $\gamma=3.2$ and $\alpha=1$ on page 273).

In the bandgap type constant voltage source, generally, the output voltage is expressed by "$m(V_{BE}+nV_T)$", where "m" and "n" are constants independent of temperature, and are determined by a resistance ratio in a specific circuit and an emitter area ratio of bipolar transistors. Here, it will be discussed on the simplest case that m=1, namely, $V_{BO}=V_{BE}+nV_T$. For example, the bandgap type constant voltage source shown in FIG. 1 is this type. The following equation can be obtained by differentiating this equation and substituting the equation (4):

$$dV_{BO}/dT=(V_{BO}-Vg)/T \quad (5)$$

Here, "n" is selected to the effect that the derivative of $V_{BO}$ with respect to temperature ($V_{BO}$ differentiated by temperature) becomes zero at a certain temperature of $T=T_N$ in the range of an ordinary temperature. As a result, the following equation can be obtained from the equation (5):

$$V_{BO}(T_N)=Vg(T_N)=V_{GO}+2kT_N/q$$

As mentioned hereinbefore, this $Vg(T_N)$ is conveniently called the bandgap voltage and identified with "Vgn". In addition, since the differentiation with temperature is zero, $V_{BO}$ is almost constant in the proximity of $T=T_N$, and therefore, can be approximated to be equal to $Vg(T_N)$. Now, assuming $T_N=300K$, since $V_T\approx 26$ mV, in the proximity of $T_N=300K$, it is possible to approximate as follows;

$$V_{BO}=1205\text{ mV}+2\times 26\text{ mV}=1257\text{ mV}$$

Namely, if it is attempted to make zero the temperature characteristics of the output voltage of the bandgap type constant voltage source, it is possible to obtain only a voltage value near to the bandgap voltage Vgn.

In the second prior art reference voltage generating circuit shown in FIG. 2, on the other hand, it is discussed on the case that this bandgap type constant voltage source is used as the constant voltage source 10A for generating the standardized constant voltage $V_{CS}$. Since the derivative of $V_{CS}$ with respect to temperature ($V_{CS}$ differentiated by temperature) is zero, it would be understood that in order to make the derivative of $V_R$ with respect to temperature ($V_R$ differentiated by temperature) zero, a coefficient of the derivative of $V_{BE}$ with respect to temperature, namely, $(R_5/\Sigma R)\times[(R_{26}/R_4)-1]-1$, must be zero. If it it realized, from the equation (1), the following equation can be obtained:

$$V_R=-(R_5/\Sigma R)\cdot(R_{26}/R_4)\cdot V_{CS}$$

Here, since $(R_5/\Sigma R)\cdot(R_{26}/R_4)=1+(R_5/\Sigma R)\geqq 1$, it becomes:

$$|V_R|\geqq V_{CS}=Vgn$$

Accordingly, if the second prior art reference voltage generating circuit shown in FIG. 2 incorporates therein the bandgap type constant voltage source configured to generate the standardized constant voltage $V_{CS}$ which is equal to the bandgap voltage Vgn of the zero temperature dependency, it is impossible to generate a reference voltage $V_R$ having the zero temperature dependency and an absolute value smaller than the bandgap voltage Vgn.

Now, the case of using an ordinary constant voltage source for obtaining $V_{CS}$, will be discussed. The ordinary constant voltage source used in a semiconductor integrated circuit is constituted of the bandgap type constant voltage source 10 shown in FIG. 1 or a constant voltage source composed of a resistor RD and diodes $D_2$ and $D_3$ connected as shown in FIG. 3 to utilize a forward direction voltage of the diodes.

The constant voltage generated in the circuit shown in FIG. 1 is expressed by $V_{BO}=(V_{BE}+nV_T)$, and a standardized constant voltage $V_{BB}$ generated in the circuit shown in FIG. 3 is expressed by $V_{BB}=2V_{BE}$. Here, this example includes even the case that the bandgap type constant voltage source has circuit constants for generating the reference voltage whose temperature dependency is not zero.

As seen from the above, the standardized constant voltage generated by the conventional constant voltage source can be said to be the "m" times the sum of the bipolar transistor forward direction voltage $V_{BE}$ plus the "n" times the thermal voltage $V_T$ (standardized constant voltage=$m(V_{BE}+n\cdot V_T)$) where "m" and "n" are constants, in particular, "m" is a positive number not less than 1. In the case of using this voltage source for obtaining $V_{CS}$, when the derivative of $V_R$ with respect to temperature ($V_R$ differentiated by temperature) is zero, $V_R\leqq Vg$, namely, $|V_R|>Vg$. Accordingly, $V_{CS}=m(V_{BE}+n\cdot V_T)$.

Furthermore, if $V_{CS}=m(V_{BE}+n\cdot V_T)$ is differentiated by using the equation (4), the following equation is obtained:

$$dV_{CS}/dT=V_{CS}-m\cdot Vg$$

Furthermore, if this is substituted into the equation (2), the following equation is obtained:

$$V_R=-a\ b\ m\cdot Vg+\{a\ (b-1)-1\}\cdot Vg\ \{a\ b\ (1-m)-a-1\}\cdot Vg$$

where $a=R_5/\Sigma R$, and $b=R_{26}/R_4$

Since "m" is not less than 1 and since "a" and "b" are positive number, it would be apparent that the coefficient of Vg is not greater than −1. Namely, $V_R\leqq Vg$. Accordingly, when the constant voltage source is used for obtaining $V_{CS}$ in the prior art example, it is impossible to generate a reference voltage $V_R$ having the zero temperature dependency and an absolute value smaller than the bandgap voltage Vgn.

As seen from the above, the prior art reference voltage generating circuits cannot generate a reference voltage $V_R$ having the zero temperature dependency and an absolute value smaller than the bandgap voltage Vgn.

SUMMARY OF THE INVENTION

Accordingly, it is an object of the present invention to provide a reference voltage generating circuit which has overcome the above mentioned defects of the conventional ones.

Another object of the present invention is to provide a reference voltage generating circuit capable of generating a reference voltage having the zero temperature dependency and an absolute value smaller than the bandgap voltage.

The above and other objects of the present invention are achieved in accordance with the present invention by a reference voltage generating circuit comprises a constant voltage source connected between a high power supply voltage and a low power supply voltage for generating a standardized constant voltage measured on the basis of the low power supply voltage as a reference and a circuit receiving the standardized constant voltage. The constant voltage source is a bandgap constant voltage source. The circuit receiving the standardized constant voltage is composed of first and seconds resistors series-connected to sandwich first and second transistors therebetween, for generating a divided voltage. A constant current source composed of a third transistor receives the divided voltage. Third and fourth resistors series-connected sandwich the third transistor, and convert a current flowing through the third transistor, into an output voltage measured on the basis of the high power supply voltage as a reference. An emitter follower receives the output voltage, and generates a reference voltage measured on the basis of the high power supply voltage as a reference.

More specifically, according to the present invention, respective resistance values $R_1$, $R_2$, $R_3$ and $R_4$ of the first, second, third and fourth resistors meeting the condition that $(R_4/R_3)\cdot R_1/(R_1+R_2)$ is approximately equal to ½.

With the above mentioned arrangement, since $(R_4/R_3)\cdot R_1/(R_1+R_2)$ is approximately equal to ½,if the standardized constant voltage measured on the basis of the low power supply voltage as a reference is $V_{BB}$, the reference voltage $V_{RO}$ measured on the basis of the high power supply voltage as a reference, which is outputted from the emitter of the fourth transistor, becomes $-V_{BB}/2$. Therefore, if the constant voltage source is constituted of a bandgap type constant voltage source for generating the standardized constant voltage $V_{BB}$=2 V having almost no temperature dependency, it is possible to generate the reference voltage $V_{RO}$=−1 V, having the zero temperature dependency and an absolute value smaller than the bandgap voltage (about 1.25 V).

The above and other objects, features and advantages of the present invention will be apparent from the following description of preferred embodiments of the invention with reference to the accompanying drawings.

DESCRIPTION OF THE PREFERRED EMBODIMENTS

Figure 1:
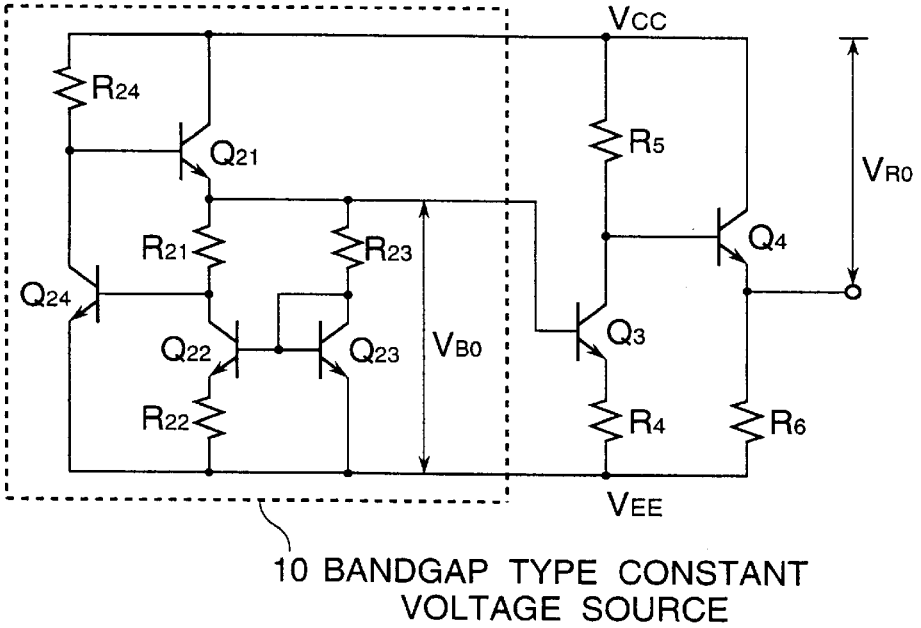
FIGURE 1 PRIOR ART
FIG. 1 is a circuit diagram of a first prior art reference voltage generating circuit utilizing the bandgap voltage.
Figure 2:
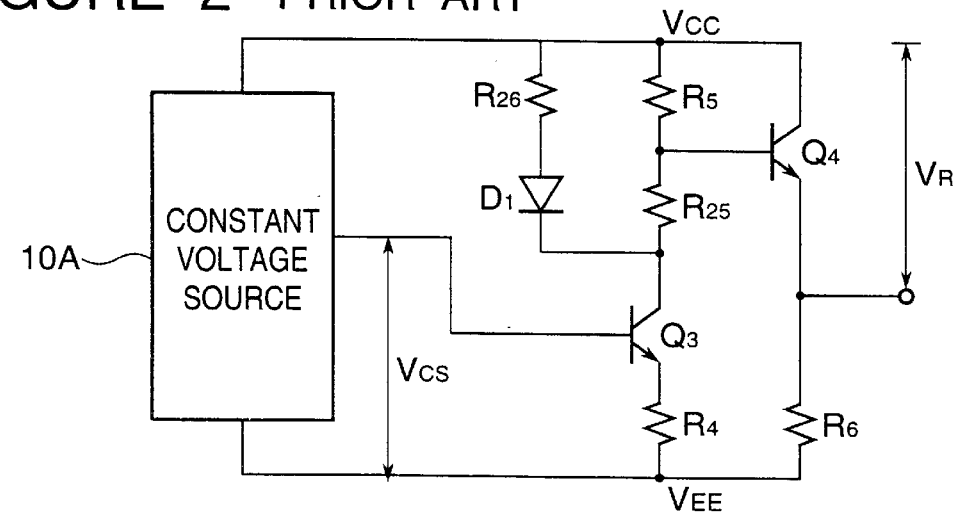
FIGURE 2 PRIOR ART
FIG. 2 is a circuit diagram of a second prior art reference voltage generating circuit.
Figure 3:
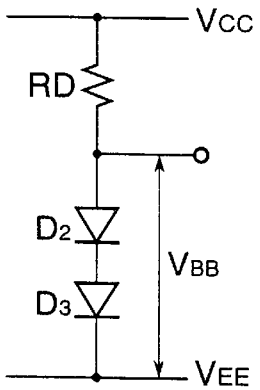
FIGURE 3 PRIOR ART
FIG. 3 is a circuit diagram of an ordinary constant voltage source used in a semiconductor integrated circuit, utilizing a forward direction voltage of diodes.
Figure 4:
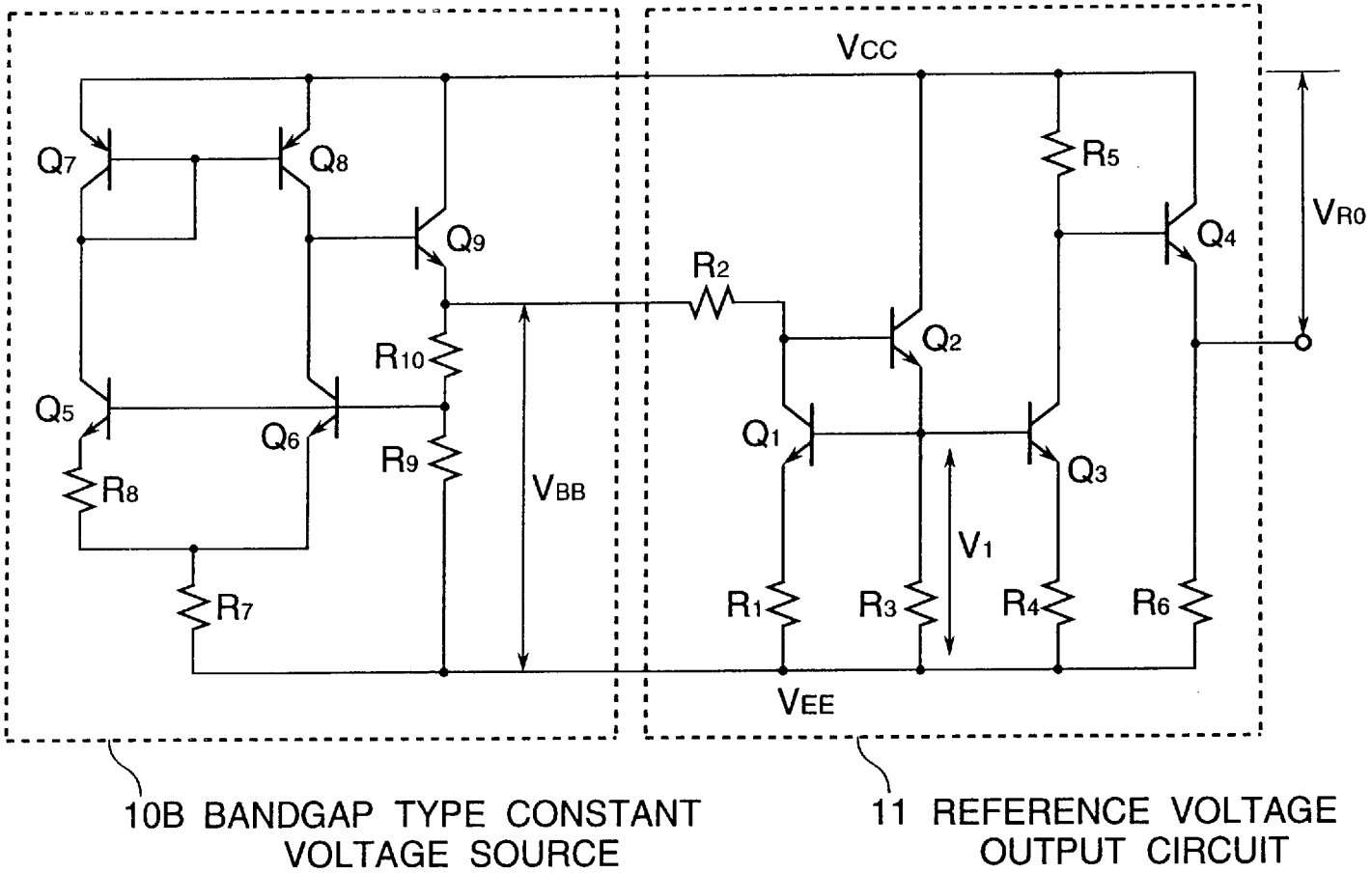
FIG. 4 is a circuit diagram of a first embodiment of the reference voltage generating circuit in accordance with the present invention.

Referring to FIG. 4, there is shown a circuit diagram of a first embodiment of the reference voltage generating circuit in accordance with the present invention.

The shown embodiment includes a bandgap type constant voltage source 10B generating a standardized constant voltage $V_{BB}$, and a reference voltage output circuit 11 receiving the standardized constant voltage $V_{BB}$, for generating a reference voltage $V_{RO}$.

The bandgap type constant voltage source 10B includes a pair of PNP bipolar transistors $Q_7$ and $Q_8$ having their emitter connected in common to a high power supply voltage $V_{CC}$ and third base connected to each other, a collector of the transistor $Q_7$ being connected to the base of the transistor $Q_7$ itself, a pair of NPN bipolar transistors $Q_5$ and $Q_6$ having their collectors connected to the collectors of the transistors $Q_7$ and $Q_8$, respectively, and their bases corrected to each other. An emitter of the transistor $Q_5$ is connected to one end of a resistor $R_8$, the other end of which is connected to an emitter of the transistor $Q_6$ and one end of a resistor $R_7$. The other end of the resistor $R_7$ is connected to a low power supply voltage $V_{EE}$. The common-connected collectors of the transistors $Q_8$ and $Q_6$ are connected to a base of an NPN bipolar transistor $Q_9$ having a collector connected to the high power supply voltage $V_{CC}$. An emitter of the transistor $Q_9$ is connected to an end of a resistor $R_{10}$, the other end of which is connected to the common-connected bases of the transistors $Q_5$ and $Q_6$ and to one end of a resistor $R_9$. The other end of the resistor $R_9$ is connected to the low power supply voltage $V_{EE}$.

With the above arrangement, the bandgap type constant voltage source 10B generates, across the series-connected resistors $R_{10}$ and $R_9$, the standardized constant voltage $V_{BB}$ which is the bandgap voltage Vgn multiplied by $\{1+(R_{10}/R_9)\}$.

The bandgap type constant voltage source 10B is realized by actualizing the circuit shown in Figure 7.12 on page 247 of L. J. Herbst, "MONOLITHIC INTEGRATED CIRCUITS", the disclosure of which is incorporated by reference in its entirety into the present application.

The reference voltage output circuit 11 includes a resistor $R_2$ having one end connected to a connection node between the emitter of the transistor $Q_9$ and the resistor $R_{10}$ so as receive the standardized constant voltage $V_{BB}$. The other end of the resistor $R_2$ is connected to a collector of an NPN bipolar transistor $Q_1$ and to a base of an NPN bipolar transistor $Q_2$ having a collector connected to the high power supply voltage $V_{CC}$. An emitter of the transistor $Q_2$ is connected to a base of each of the transistor $Q_1$ and an NPN bipolar transistor $Q_3$ and to one end of a resistor $R_3$ having the other end connected to the low power supply voltage $V_{EE}$. An emitter of the transistor $Q_1$ is connected to one end of a resistor $R_1$ having the other end connected to the low power supply voltage $V_{EE}$. An emitter of the transistor $Q_3$ is connected to one end of a resistor $R_4$ having the other end connected to the low power supply voltage $V_{EE}$. A collector of the transistor $Q_3$ is connected to a base of an NPN bipolar transistor $Q_4$ and to one end of a resistor $R_5$ having the other end connected to the high power supply voltage $V_{CC}$. A collector of the transistor $Q_4$ is connected to the high power supply voltage $V_{CC}$. An emitter of the transistor $Q_4$ is connected to one end of a resistor $R_6$ having the other end connected to the low power supply voltage $V_{EE}$.

With this arrangement, the standardized constant voltage $V_{BB}$ is divided by a series circuit composed of the first resistor $R_1$ and the second resistor $R_2$ sandwiching the first and second transistors $Q_1$ and $Q_2$ therebetween, and a divided voltage $V_1$ is supplied to a constant current source composed of the third transistor $Q_3$, and a current flowing through the constant current source is converted into a voltage by the third and fourth resistors $R_4$ and $R_5$ connected in series to sandwich the third transistor $Q_3$ therebetween, and the obtained voltage is outputted as the reference voltage $V_{RO}$ by an emitter follower composed of the fourth transistor $Q_4$.

An example of circuit parameters of the shown embodiment is as follows: $R_1$=1.5 KΩ, $R_2$=$R_5$=$R_9$=0.5 KΩ, $R_3$=5.5 KΩ, $R_4$=0.75 KΩ, $R_6$=3.5 KΩ, $R_7$=0.46 KΩ, $R_8$=0.12 KΩ, $R_{10}$=0.3 KΩ. The emitter area ratio is $Q_5$:$Q_6$=10:1, and $Q_1$:$Q_2$:$Q_3$:$Q_4$=1:1:2:5. $V_{CC}$=GND=0V, $V_{EE}$=−4.5 V.

Now, operation of the shown embodiment will be described.

The bandgap type constant voltage source 10B generates the standardized constant voltage $V_{BB}$ having the zero temperature dependency.

$$V_{BB}=\{1+(R_{10}/R_9)\}\cdot Vgn=\{1+(3/5)\}\cdot 1250\ \text{mV}=2\text{V}$$

If a base potential of the transistor Q3 is expressed by V1 measured on the basis of $V_{EE}$ as a reference, the reference voltage $V_{RO}$ measured on the basis of $V_{CC}$ as a reference is expressed by the following equations:

$$V1 = (R_2 \cdot V_{BE1} - R_1 \cdot V_{BE2} + R_1 \cdot V_{BB})/(R_1 + R_2)$$

$$\begin{aligned} V_{RO} &= -(R_5/R_4)\cdot(V_1 - V_{BE3}) - V_{BE4} \\ &= -V_{BB} + a(V_{BE1} + V_{BE2}) + (R_5/R_4)\cdot \\ &\quad (V_{BE3} - V_{BE1}) - V_{BE4} \end{aligned}$$

where $a=(R_5/R_4)\cdot R_1/(R_1+R_2)$

Here, for simplification, assuming $V_{BE1}=V_{BE2}=V_{BE3}=V_{BE4}=V_{BE}$, the following equation can be obtained:

$$V_{RO}=-a\cdot V_{BB}+(2a-1)\cdot V_{BE}$$

In this embodiment, if it is assumed that the emitter area of the bipolar transistors are selected to obtain $V_{BE1}$=0.8V at an ordinary temperature, a current flowing through each of the bipolar transistors $Q_1$ and $Q_2$ becomes 0.2 mA, and a current flowing through the bipolar transistor $Q_3$ becomes 0.4 mA, and further, a current flowing through the bipolar transistor $Q_4$ becomes 1 mA. Therefore, since the emitter area ratio is $Q_1$:$Q_2$:$Q_3$:$Q_4$=1:1:2:5, the current density becomes equal between the bipolar transistors $Q_1$ to $Q_4$, and therefore, the forward direction voltage of these bipolar transistors are almost equal in the neighborhood of the ordinary temperature.

Here, if the values of the resistors $R_1$, $R_2$, $R_4$ and $R_5$ are selected to obtain a=½, it becomes $V_{RO}=-V_{BB}/2$. In the shown embodiment, since it was actually a=½, and since $V_{BB}$ was the standardized constant voltage having the zero temperature dependency, the reference voltage $V_{RO}$ having the zero temperature dependency could be obtained. Since $V_{BB}$=2V as mentioned above, it becomes $V_{RO}$=−1 V. Namely, the reference voltage having the zero temperature dependency and an absolute value smaller than the bandgap voltage Vgn=1.25 V, could be obtained.

Incidentally, in an actual circuit, $V_{BE1}$ to $V_{BE4}$ may not often become completely equal to each other in all characteristics including a temperature characteristics. In this case, it is in some cases possible to minimize the temperature dependency of the reference voltage by slightly shifting the resistance ratio "a"=$(R_5/R_4)\cdot R_1/(R_{1\ +R2})$ from ½.

Figure 5:
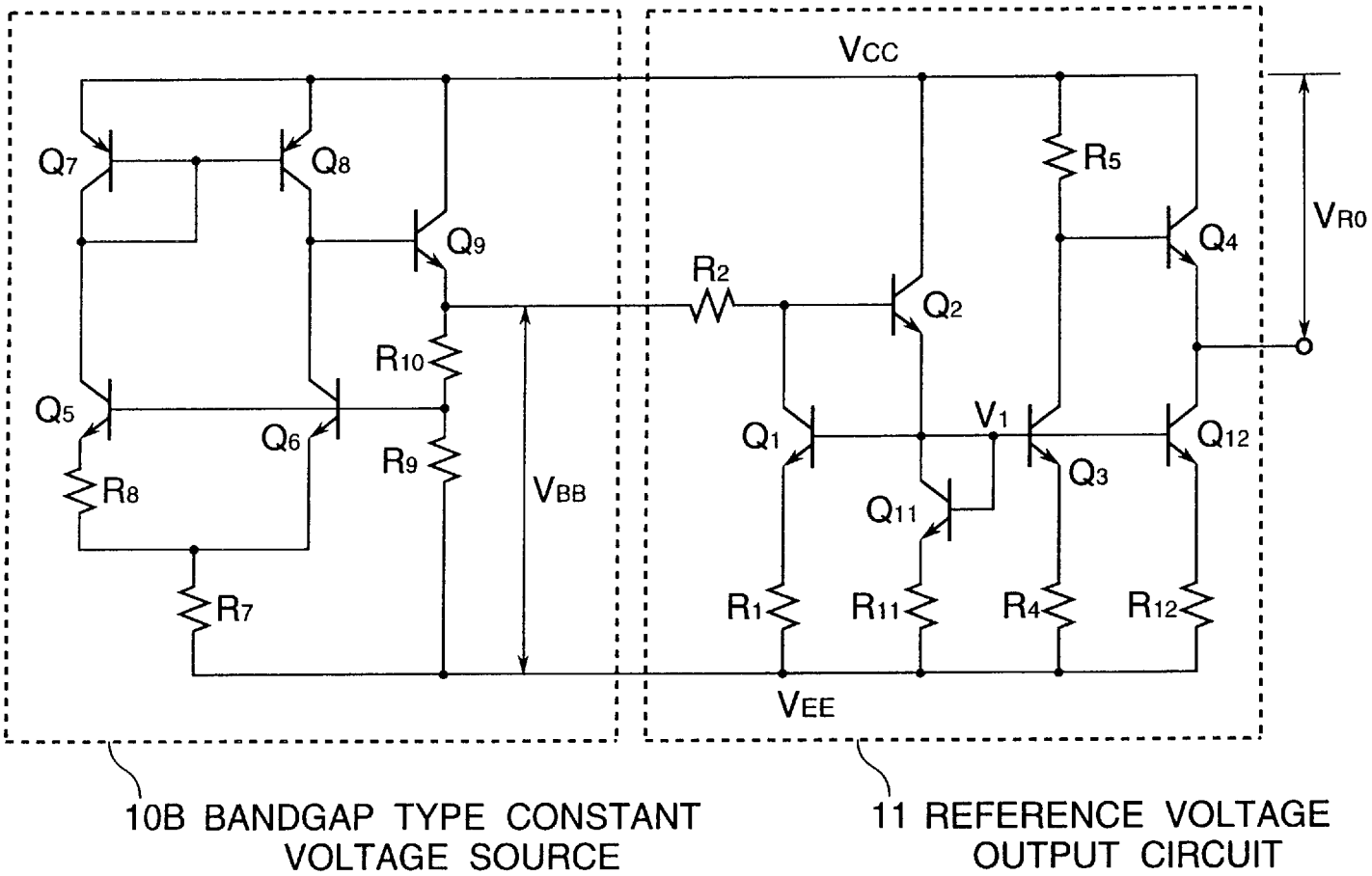
FIG. 5 is a circuit diagram of a second embodiment of the reference voltage generating circuit in accordance with the present invention.

Referring to FIG. 5, there is shown a circuit diagram of a second embodiment of the reference voltage generating circuit in accordance with the present invention. In FIG. 5, elements corresponding to those shown in FIG. 4 are given the same Reference Numerals and Signs, and explanation thereof will be omitted.

As seen from comparison between FIGS. 4 and 5, the second embodiment is different from the first embodiment in that the resistor $R_{13}$ in the first embodiment is replaced by a NPN bipolar transistor $Q_{11}$ having a collector and a base connected to the base of the transistors $Q_1$ and $Q_3$, and a resistor $R_{11}$ connected between an emitter of the transistor $Q_{11}$ and the low power supply voltage $V_{EE}$, and the resistor $R_6$ in the first embodiment is replaced by a NPN bipolar transistor $Q_{12}$ having a collector connected to the emitter of the transistor $Q_4$ and a base connected to the base of the transistors $Q_1$ and $Q_3$, and a resistor $R_{12}$ connected between an emitter of the transistor $Q_{12}$ and the low power supply voltage $V_{EE}$. In addition, the resistance ratio and the emitter area ratio in circuit parameters of the second embodiment is the same as those of the first embodiment. Furthermore, $R_{11}$=1.5 KΩ (=$R_1$), $R_{12}$=0.3 KΩ (=$R_1$/5). $Q_{11}$:$Q_{12}$:$Q_1$=1:5:1.

With this arrangement, the current density of the transistors $Q_1$, $Q_2$, $Q_3$ and $Q_4$ becomes almost equal, even if the temperature changes. Therefore, the forward direction voltage of these bipolar transistors can be made equal in all characteristics including the temperature dependency. Accordingly, it is possible to minimize an error attributable to differences of the forward direction voltages, between the calculated values of the first embodiment and an actual circuit, so that it is possible to generate the reference voltage having almost no temperature dependency.

As seen from the above, the reference voltage generating circuit in accordance with the present invention is capable of generating a reference voltage having the zero temperature dependency and an absolute value smaller than the bandgap voltage Vgn. The reason for this is that: (1) By suitably selecting the resistance ratio in the reference voltage generating circuit, it is possible to generate the reference voltage having a magnitude which a half of the standardized constant voltage outputted from the constant voltage source. (2) The constant voltage source is the bandgap type constant voltage source configured to generate the standardized constant voltage which is smaller than a double of the bandgap voltage Vgn, but larger than the bandgap voltage Vgn.

The invention has thus been shown and described with reference to the specific embodiments. However, it should be noted that the present invention is in no way limited to the details of the illustrated structures but changes and modifications may be made within the scope of the appended claims.

I claim:

1. A reference voltage generating circuit comprising:

a constant voltage source connected between a high power supply voltage and a low power supply voltage for generating a standardized constant voltage measured on the basis of the low power supply voltage as a reference, the constant voltage source being a bandgap type voltage source;

a circuit receiving said standardized constant voltage, and composed of first and second resistors series-connected to sandwich first and second transistors therebetween, for generating a divided voltage, said first resistor being connected to receive the standardized constant voltage and the second resistor being connected to the low power supply voltage;

a constant current source comprising a third transistor having a base receiving said divided voltage;

third and fourth resistors series-connected to sandwich said third transistor, for converting a current flowing through said third transistor, into an output voltage measured on the basis of the high power supply voltage as a reference; and an emitter follower comprising a fourth transistor having a base receiving said output voltage, for generating a reference voltage measured on the basis of the high power supply voltage as a reference, wherein the reference voltage has a zero temperature dependency and an absolute value smaller than a bandgap voltage in the constant voltage source.

2. A reference voltage generating circuit comprising:

a constant voltage source connected between a high power supply voltage and a low power supply voltage for generating a standardized constant voltage measured on the basis of the low power supply voltage as a reference, the constant voltage source being a bandgap type voltage source; and a reference voltage output circuit comprising a circuit receiving said standardized constant voltage, and composed of first and second resistors series-connected to sandwich first and second transistors therebetween, for generating a divided voltage, the first resistor being connected to receive the standardized constant voltage and the second resistor being connected to the low power supply voltage;

a constant current source comprising a third transistor having a base receiving said divided voltage;

third and fourth resistors series-connected to sandwich said third transistor, for converting a current flowing through said third transistor, and output voltage measured on the basis of the high power supply voltage as a reference; and an emitter follower comprising a fourth transistor having a base receiving said output voltage, for generating a reference voltage measured on the basis of the high power supply voltage as a reference, wherein the reference voltage has a zero temperature dependency and an absolute value smaller than a bandgap voltage in the constant voltage source.

3. A reference voltage generating circuit comprising:

a constant voltage source connected between a high power supply voltage and a low power supply voltage for generating a standardized constant voltage measured on the basis of the low power supply voltage as a reference, the constant voltage source being a bandgap type voltage source; and a reference voltage output circuit including a first transistor having an emitter connected through a first resistor to the low power supply voltage, a collector connected to receive through a second resistor said standardized constant voltage, and a base connected through a biasing means to the low power supply voltage, a second transistor having a base and an emitter connected to the collector and the base of said first transistor, and a collector connected to said high power supply voltage, a third transistor having a base connected to said emitter of said second transistor, an emitter connected through a third resistor to said low power supply voltage, and a collector connected through a fourth resistor to said high power supply voltage, and a fourth transistor having a base connected to said collector of said third transistor, and constituting an emitter follower so that a reference voltage measured on the basis of said high power supply voltage as a reference is outputted from an emitter of said fourth transistor, respective resistance values $R_1$, $R_2$, $R_3$ and $R_4$ of said first, second, third and fourth resistors meeting the condition that $(R_4/R_3)\cdot R_1/(R_1+R_2)$ is approximately equal to ½, wherein the reference voltage has a zero temperature dependency and an absolute value smaller than a bandgap voltage in the constant voltage source.

4. A reference voltage generating circuit claimed in claim 3 wherein an emitter area ratio of said first, second, third and fourth transistors is 1:1:2:5.

5. A reference voltage generating circuit claimed in claim 3 wherein said biasing means is constituted of a resistor.

6. A reference voltage generating circuit claimed in claim 3 wherein said biasing means is constituted of a fifth transistor having a collector and a base connected in common to the base of said first transistor, and a fifth resistor connected between an emitter of said fifth transistor and said low power supply voltage, and further including a sixth transistor having a collector connected to the emitter of said fourth transistor and a base connected to the base of said first transistor, and a sixth resistor connected between an emitter of said sixth transistor and said low power supply voltage.

7. A reference voltage generating circuit claimed in claim 6 wherein a resistance of said fifth resistor is equal to that of said first resistor and a resistance of said sixth resistor is one fifth of that of said first resistor, and wherein an emitter area of said fifth transistor is equal to that of said first transistor, and an emitter area of said fifth transistor is five times the emitter area of said first transistor.

* * * * *